United States Patent [19]

Doty

[11] Patent Number: 4,993,080

[45] Date of Patent: Feb. 19, 1991

[54] HEADBAND

[76] Inventor: Robert M. Doty, 1075 N. Miller Rd. #149, Scottsdale, Ariz. 85271

[21] Appl. No.: 328,861

[22] Filed: Mar. 27, 1989

[51] Int. Cl.[5] ..... A42B 1/24

[52] U.S. Cl. ..... 2/181; 2/207; 2/DIG. 11; D2/512; D2/515

[58] Field of Search ..... 2/181, 207, 209.1, DIG. 11, 2/171; D2/252, 253, 500, 502, 503, 505, 508, 509, 512, 513, 514, 515

[56] References Cited

U.S. PATENT DOCUMENTS

| | | | |
|---|---|---|---|
| D. 109,690 | 5/1938 | Atwood | D2/500 |
| D. 165,054 | 11/1951 | Crowthers | D2/512 |
| 2,005,361 | 6/1935 | Rollins | D2/515 |
| 2,256,866 | 9/1941 | Goodall | D2/512 |
| 2,600,814 | 6/1952 | Tomarkin | D2/502 |
| 4,394,782 | 7/1983 | Wasson | 2/181 |
| 4,499,741 | 2/1985 | Harris | 2/DIG. 11 |
| 4,520,510 | 6/1985 | Daigle | 2/207 |
| 4,723,325 | 2/1988 | Perry | 2/181 |

FOREIGN PATENT DOCUMENTS

| | | | |
|---|---|---|---|
| 2449177 | 4/1975 | Fed. Rep. of Germany | 2/207 |
| 1187256 | 9/1959 | France | D2/515 |

OTHER PUBLICATIONS

Spencer Gifts catalogue (1964) p. 38.

*Primary Examiner*—Werner H. Schroeder
*Assistant Examiner*—Diana L. Biefeld
*Attorney, Agent, or Firm*—Donald D. Mon

[57] ABSTRACT

A headband comprising an imperforate piece of cloth having edges, a nominal fold axis, and ends of reduced width at the ends of said axis which can be tied together to form the headband. A message strip along the axis can carry a message on one side of the fold. A tassel strip is on the opposite side of the message strip from the fold. At least one tassel is fixed to it. When the cloth is properly folded, the tassel strip is against the head and the message strip is on the outside with its message visible. The tassel hangs fully exposed below the headband.

3 Claims, 1 Drawing Sheet

FIG. 1
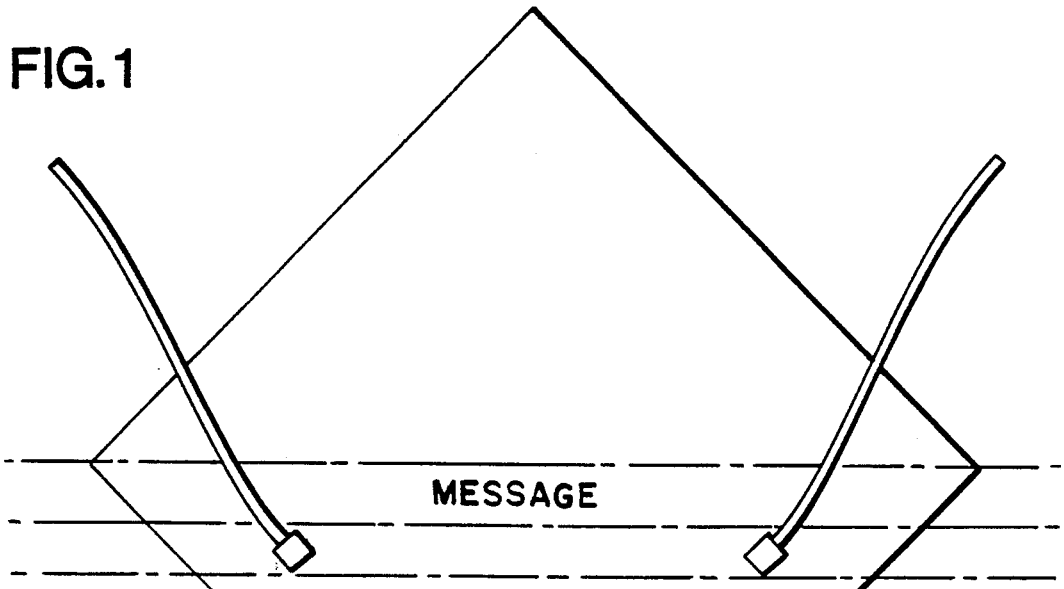
FIG.2
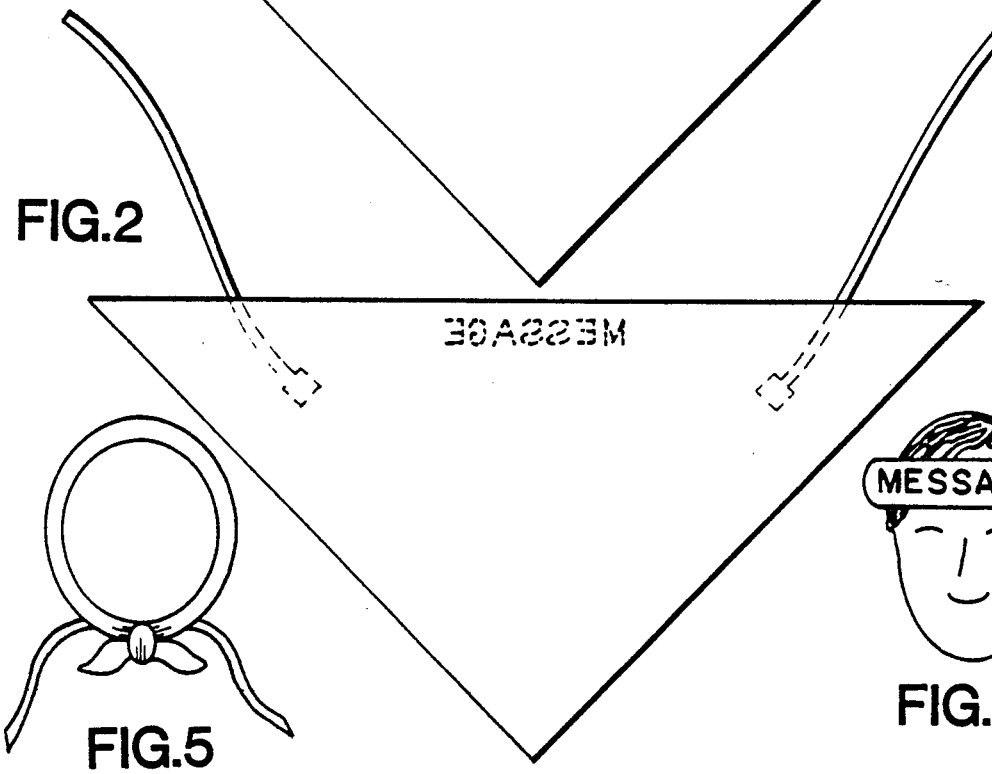
FIG.5
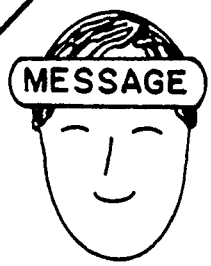
FIG.6
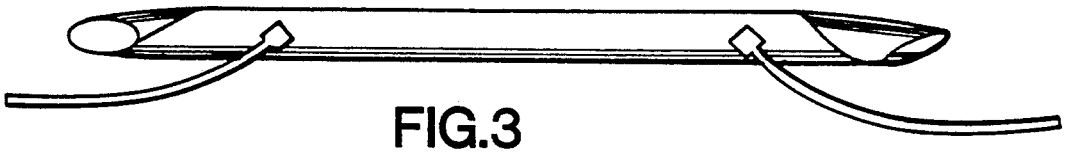
FIG.3
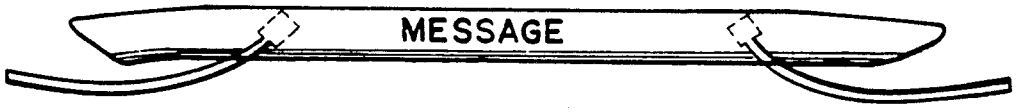
FIG.4

HEADBAND

FIELD OF THE INVENTION

This invention relates to a headband formed by a folded cloth.

BACKGROUND OF THE INVENTION

Headbands are popular for personal decoration as well as for absorbing perspiration. Elasticized headbands of absorptive material are well-known, and often prominently bear the name of their manufacturer, or even of some sponsor.

Known headbands are because of their nature flat, and not particularly distinctive for that reason. Further, they have only the single use—absorption.

It is an object of this invention to provide a headband which as a distinctive body can have optional uses such as a bandanna or handkerchief, which can bear a message such as a slogan, logo, or name, and which can be provided with tassels that can be decorative in themselves or to which novelties can be attached.

The headband of this invention thereby has an enhanced usage, and is inherently more attractive than known headbands. It is very suitable as a novelty item at sports events for example.

BRIEF DESCRIPTION OF THE INVENTION

A headband according to this invention is a piece of flexible cloth having a nominal axis with a substantial area on each side of this axis. The piece of cloth tapers at the ends of the axis to facilitate tying them together around the head.

The piece is so proportioned that when folded along the axis there is a continuous message strip adjacent to the fold having a substantial lateral dimension. The piece can then be successively folded up from the edges farthest removed from the axis, leaving the message strip exposed when the ends are tied together.

According to a preferred but optional feature of the invention a tassel strip extends along and adjacent to the message strip. A tassel, preferably a pair of tassels, are attached to the tassel strip. When the headband is folded, the tassel strip will face oppositely from the message strip, toward the head, and the tassels will freely hang from that strip down the back of side of the head.

The above and other features of this invention will be fully understood from the following detailed description and the accompanying drawings, in which:

BRIEF DESCRIPTION OF THE DRAWINGS

FIG. 1 is a plan view of the headband, unfolded;

FIG. 2 is a plan vieW of the headband's first fold;

FIG. 3 is a side view of one side of the fully folded headband;

FIG. 4 is a side view of the other side of the fully folded headband;

FIG. 5 is a top view of the fully folded headband around the head of a wearer; and FIG. 6 is a front view showing the headband on the head of a wearer.

DETAILED DESCRIPTION OF THE INVENTION

FIG. 1 shows a headband 10 in its unfolded, flat condition. It is a piece 11 of flexible, foldable cloth, preferably such as used for handkerchiefs or bandannas. It can be used for general purposes when not used as a headband.

In its preferred shape it will be rectangular with four edges 12, 13, 14 and 15.

Nominal axis 16, preferably but not necessarily central, extends between two of its ends 17, 18 where two edges meet to form tapered regions 19, 20, which reduce the lateral width at the ends so as to facilitate tying a knot 21 (FIG. 5) to fix the headband around the head. Other tapering or narrowed end shapes could be used instead, to reduce the bulk of material in the knot.

A message strip 25 extends adjacent to and parallel to the axis. It has a substantial width 26 to receive a message 27. The message can be of any visible kind—for example names, logos, and slogans.

Axis 16 is also the fold line for the principal fold 28 of this headband, so that the message strip will be visible when the headband is in place (FIG. 6), and it makes a neat lower visible edge for the headband.

An optional tassel strip 30 extends adjacent to and parallel to the message strip. It has a dimension of width 31. Line 82 represents a next fold such that the tassel strip will bear against the head when the headband is worn.

One or more tassels 33, 84 are fixed to the tassel strip. As best shown in FIG. 8, they will dangle freely from the headband. They can be decorative in themselves. Also trinkets, feathers, beads, novelties, and other decorative articles can be attached to the tassels for the enjoyment of the wearer and others.

The headband is prepared by making the principal fold 28 as shown in FIG. 2. The message strip and the tassel strip are both on the bottom. Then successive folds are made in an upwardly rolling manner ("roll fold") until the shape of FIGS. 3 and 4 is produced when it is flattened. The terms "folding" and "rolling" are used synonymously, because while the headband does not become absolutely flat, wrapping the headband around the head and tying it does reduce its dimensions from those of a circular roll. This is how the message strip becomes substantially planar, but has gently curved axially extending edges.

The resulting headband is considerably more agreeable to the sight than a flat strip of cloth. It has a substantial bulk with gently rounded contours.

The tassels are an optional feature of the invention.

The width of the message strip is conveniently about $1\frac{1}{2}$ inches. The inside fold surfaces are progressively smaller. The user will soon learn to make his folds in such a way as to end up with a message strip of proper dimensions, and With the tassels properly located.

A square piece of cloth with edges about 20 inches long has been found to produce a widely useful size of headband, and also to provide a piece of cloth useful for more general purposes.

This invention is not to be limited by the embodiment shown in the drawings and described in the description, which is given by way of example and not of limitation, but only in accordance with the scope of the appended claims.

I claim:

1. A headband comprising an imperforate piece of cloth having edges, a nominal fold axis, and ends of reduced width at the ends of said axis, said reduced width enabling said ends to be tied together, said piece having a message strip contiguous to and parallel to said axis, said message strip having a substantial lateral dimension of width and being adapted to bear a message, said head band having been folded along said axis along a principal fold, and roll-folded from the lateral edges of said piece toward said principal fold to leave the message strip flat and exposed when said ends are tied together, with the headband around the head, said piece including a tassel strip contiguous to and parallel to said message strip on the opposite side of said message strip from said nominal axis, said tassel strip having a substantial lateral dimension of width, and at least one elongated tassel attached to and depending from said tassel strip at a location substantially spaced from the tied ends of the folded piece of cloth, said folds being so proportioned that the tassel strip in the folded configuration abuts the head when the headband is wrapped around the head and the tassel is fully exposed.

2. A headband according to claim 1 in which the piece is square and is made of water absorbent cloth.

3. A headband according to claim 1 in which the message strip bears a message.

* * * * *